United States Patent [19]

Röck et al.

[11] 4,367,566

[45] Jan. 11, 1983

[54] MOUNTING PLATE FOR A FURNITURE HINGE

[75] Inventors: Erich Röck; Herbert Blum, both of Höchst, Austria

[73] Assignee: Julius Blum Gesellschaft m.b.H., Höchst, Austria

[21] Appl. No.: 160,738

[22] Filed: Jun. 18, 1980

[30] Foreign Application Priority Data

Jul. 2, 1979 [AT] Austria ..... 4601/79

[51] Int. Cl.[3] ..... E05D 7/04

[52] U.S. Cl. ..... 16/236

[58] Field of Search ..... 16/129, 130, 133, 236, 16/237, 248, 249

[56] References Cited

U.S. PATENT DOCUMENTS 4,091,499 5/1978 Lautenschlager ..... 16/129

FOREIGN PATENT DOCUMENTS 2601809 7/1977 Fed. Rep. of Germany ..... 16/129

2734017 2/1979 Fed. Rep. of Germany ..... 16/129

*Primary Examiner*—Werner H. Schroeder

*Assistant Examiner*—Andrew M. Falik

*Attorney, Agent, or Firm*—Wenderoth, Lind & Ponack

[57] ABSTRACT

A multimember mounting plate assembly is provided as a base plate for a hinge arm of a furniture hinge. The position of the hinge arm is adjustable on the assembly in the direction of the depth of the piece of furniture and the direction of the breadth of the door joint. The assembly provides an additional possibility of adjustment in the direction of the height of the piece of furniture. The mounting plate assembly includes a carrier plate for the hinge arm. The carrier plate is slidably mounted on the mounting plate, and a clamping screw is provided which fixes the carrier plate to the mounting plate in a desired position.

4 Claims, 5 Drawing Figures

MOUNTING PLATE FOR A FURNITURE HINGE

BACKGROUND OF THE INVENTION

The present invention relates to a multimember base plate assembly for furniture hinges adapted to be fastened to the hinge of a hinge arm and including a mounting plate fastenable to a furniture side wall and a carrier plate anchorable to the mounting plate, the carrier plate being provided with structure for connection to the hinge arm and being fixable to the mounting plate by means of a clamping screw.

It is a requirement of hinges in furniture construction that the hinge arm, which is connected with a hinge casing inserted in a furniture door by means of hinge links, quickly and easily can be fastened and anchored to a base plate which is fastened to a furniture side wall.

It further should be possible to change and adjust the position of the hinge arm in order to overcome inaccuracies which may have been caused when drilling fastening holes.

It generally is possible to adjust the hinge are in the direction of the breadth of the door joint and in the direction of the depth of the piece of furniture.

SUMMARY OF THE INVENTION

It is the object of the present invention to provide a base plate allowing further adjustment of the hinge arm and, an adjustment in the direction of the height of the piece of furniture in particular.

The carrier plate should be precisely guided on the mounting plate so that the carrier plate does not tilt or distort on the mounting plate under the weight of the door. Moreover, the carrier plate should be adapted to be quickly fixed to the mounting plate.

According to the present invention, this is achieved by linking the carrier plate to the mounting plate on one side of the center axis of the hinge arm by means of engaging projections, and by clamping the carrier plate to the mounting plate by means of a clamping screw on the other side of the hinge arm, the clamping screw extending through a slot in the carrier plate. The projections extend outwardly from the carrier plate in directions transverse to the elongation of the slot.

A preferred embodiment of the present invention provides that the projections on the mounting plate are marginal flanges extending into guiding grooves in the carrier plate. The grooves are defined by projections of the carrier plate and by the rim of the carrier plate.

In the guiding grooves, the marginal flanges form a type of slide for the carrier plate. The longer the marginal flanges and the guiding grooves, the greater the resistance of the carrier plate to torsion.

The length of the marginal flanges is preferably shorter than the length of the guiding grooves by the amount of possible hinge adjustment in this direction. Such amount corresponds to the length of the slot on the other side of the base plate. Hence, the projections of the mounting plate are covered by the carrier plate in any position of the carrier plate. This is desirable with respect to the design of the overall hinge construction.

A further embodiment provides that the marginal flanges and the slot extend transversely of the longitudinal center axis of the hinge arm, thereby adapting the base plate to provide an adjusting possibility in the direction of the height of the piece of furniture.

A further embodiment provides that the mounting plate is T-shaped, when seen from the top, and that a fastening screw is arranged in each of the three leg portions of the T-shape.

This embodiment provides a particularly stable anchoring of the mounting plate on the furniture side wall.

BRIEF DESCRIPTION OF THE DRAWINGS

In the following, an embodiment of the present invention will be described in greater detail with reference to the accompanying drawings, without being limited thereto, wherein.

DESCRIPTION OF THE PREFERRED EMBODIMENT

Figure 1:
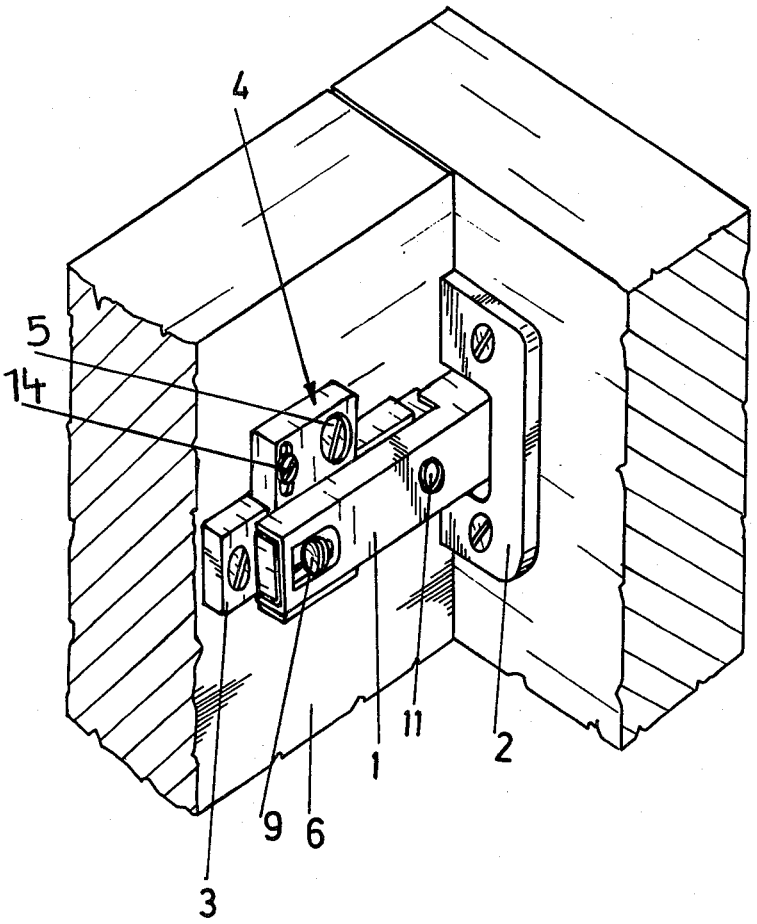
FIG. 1 is a schematic view of a hinge with a base plate in accordance with the present invention.

The other parts of the hinge, i.e. the hinge arm 1, the hinge casing 2 and the two connecting hinge links will not be described in detail as they are not subject of the present invention and are well known to any person skilled in the art.

The base plate in accordance with the present invention comprises a mounting plate 3 and a carrier plate 4. The mounting plate 3 is fastened to a furniture side wall 6 by means of fastening screws 5 and carries the carrier plate 4.

The carrier plate 4 is provided with fastening means for anchoring the hinge arm 1. The plate has a base 7 with a female thread 8 for a fastening screw 9 for the hinge arm 1 and has at its front a T-shaped recess 10, the head of an adjusting screw 11 for joint adjustment of the hinge arm 1 being inserted into recess 10.

Figure 5:
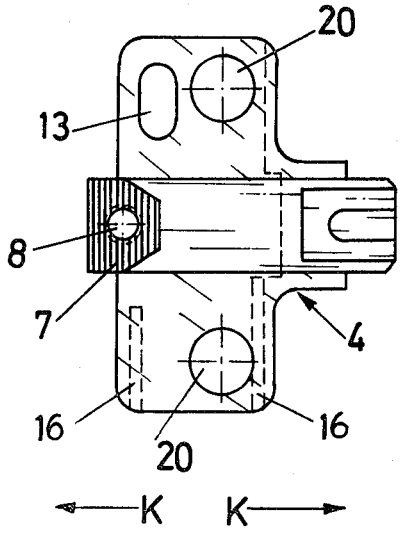
FIG. 5 is a top view of the carrier plate in accordance with the present invention.

The carrier plate 4 has lateral wing portions which extend transversely to the longitudinal center axis of the hinge arm 1. The mounting plate 3 has leg portions extending transversely of the center axis. A leg portion on one side of the hinge 1 is provided with projections 12, which are marginal flanges on both sides of such leg portion of the mounting plate 3. Projections 12 (arrows K in FIG. 5) are opposed to one another and extend from plate 3 in the direction of the lengthwise dimension of the hinge arm 1.

In the wing portion on the other side of the hinge arm 1, the carrier plate 4 is provided with a slot 13 extending transverse to the longitudinal center axis of the hinge arm 1.

A clamping screw 14, which engages a female thread 15 in the mounting plate 3, extends through the slot 13.

The carrier plate 4 is pushed onto the mounting plate 3, the projections 12 of the mounting plate 3 engaging grooves 16 of the carrier plate 4. The grooves 16 are defined by a rim 18 of the carrier plate 4 and by projections extending inwardly from rim 18, i.e. grooves 16 extend into inner surfaces of rim flanges extending downwardly from rim 18 on opposite sides of the wing portion. On the other side of the hinge arm 1, the carrier plate 4 is retained on the mounting plate 3 by means of the clamping screw 14.

Figure 2:
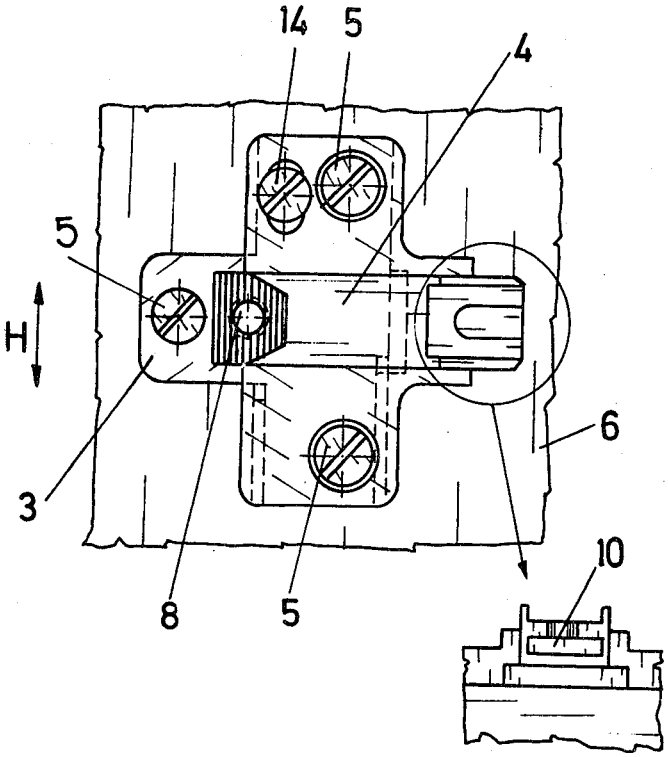
FIG. 2 is a top view of the base plate in accordance with the present invention and a detailed end view of the base plate in the inserting direction of the hinge arm.
Figure 3:
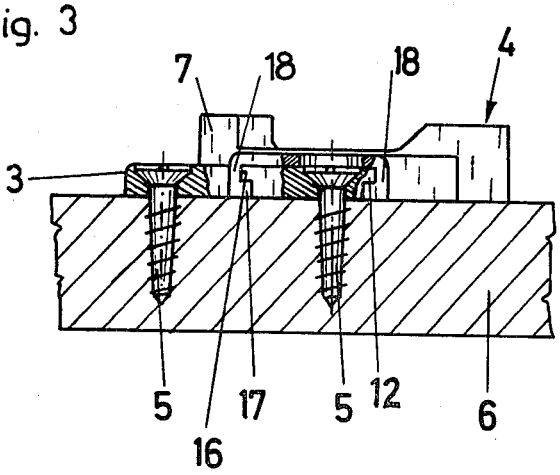
FIG. 3 is a side view of the base plate in accordance with the present invention, with parts thereof in section.

When the clamping screw 14 has been unscrewed, the carrier plate 4 can be moved in the direction of the double arrow H (FIG. 2), whereby carrier plate 14 is torsion-resistantly retained on the mounting plate 3. This resistance to torsion is particularly effected by guiding the projections 12 in the grooves 16.

When the carrier plate 4 is in the desired position, the clamping screw 14 is fastened.

Figure 4:
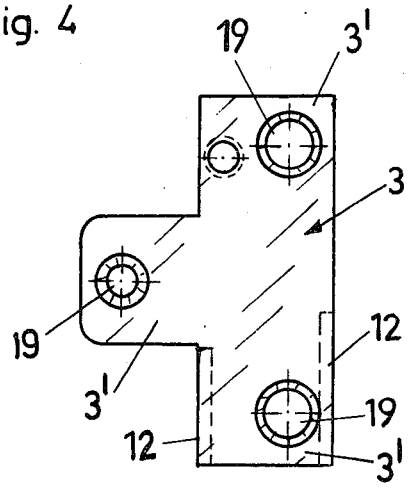
FIG. 4 is a top view of the mounting plate in accordance with the present invention.

As best shown in FIG. 4, the mounting plate 3 is T-shaped, a hole 19 for a fastening screw 5 being provided in each leg 3' of the T-shape.

The carrier plate 4 has corresponding holes 20 so that the fastening screws 5 can be fastened by means of a screw driver or the like, even when the carrier plate 4 has been mounted on the mounting plate 3, i.e. the carrier plate 4 and the mounting plate 3 are mounted to the furniture side wall 6 as an assembled unit.

One bar 3' of the mounting plate, i.e. the bar extending in the same direction as the hinge arm 1, is not covered by carrier plate 4, even when carrier plate 4 has been mounted on mounting plate 3, so that the fastening screw 5 on such one bar 3' always will be accessible.

What is claimed is:

1. A multimember base plate assembly for mounting a hinge arm of a furniture hinge to a furniture side wall, said assembly comprising:

a mounting plate adapted to be fastened to a furniture side wall;

a carrier plate adjustably fastened to said mounting plate, said carrier plate including means for mounting thereon a hinge arm to extend along a longitudinal center axis;

said mounting plate having first and second leg portions extending transversely of said center axis on opposite sides thereof, and said carrier plate having first and second wing portions extending transversely of said center axis on opposite sides thereof;

first mounting means located on one side of said longitudinal center axis for attaching said first wing portion of said first leg portion, said first mounting means comprising longitudinal grooves formed in said first wing portion and longitudinal projections on said first leg portion, said projections extending into said grooves;

second mounting means for attaching said second wing portion to said second leg portion on the opposite side of said longitudinal center axis, said second mounting means comprising a threaded hole in said second leg portion, an elongated slot in said second wing portion overlying said threaded hole, and a clamping screw extending through said slot and threaded into said threaded hole, whereby loosening of said clamping screw allows displacement of said carrier plate relative to said mounting plate in opposite directions; and said projections extending from said first leg portion in directions transverse to the direction of elongation of said slot.

2. An assembly as claimed in claim 1, wherein said projections are marginal flanges extending from opposite sides of said first leg portion, and said grooves extend into inner surfaces of flanges extending downwardly from opposite sides of said first wing portion.

3. An assembly as claimed in claim 1, wherein said mounting plate has a generally T-shaped configuration including said first and second oppositely directed leg portions and a third leg portion extending generally parallel to said center axis, each said leg portion having therein a hole for the receipt of a fastening screw for attaching said mounting plate to the furniture side wall.

4. An assembly as claimed in claim 1, wherein said projections and grooves have longitudinal dimensions extending transverse to said center axis and guide said carrier plate for longitudinal movement relative to said mounting plate in opposite directions transverse to said center axis, and said slot is elongated in a direction transverse to said center axis.

* * * * *

UNITED STATES PATENT AND TRADEMARK OFFICE

CERTIFICATE OF CORRECTION

PATENT NO. : 4,367,566

DATED : Jan. 11, 1983

INVENTOR(S) : Erich Röck

It is certified that error appears in the above-identified patent and that said Letters Patent is hereby corrected as shown below:

Claim 1, line 17,
(Col. 4, line 1,) change "portion of said first leg portion," to read --portion to said first leg portion,--.

Signed and Sealed this

Eighth Day of March, 1988

*Attest:*

DONALD J. QUIGG

*Attesting Officer*

*Commissioner of Patents and Trademarks*